US005614122A

United States Patent [19]

Schwörer

[11] Patent Number: 5,614,122

[45] Date of Patent: Mar. 25, 1997

[54] CEILING FORM

[75] Inventor: Artur Schwörer, Senden, Germany

[73] Assignee: Peri GmbH, Weissenhorn, Germany

[21] Appl. No.: 492,120

[22] PCT Filed: Feb. 10, 1994

[86] PCT No.: PCT/DE94/00154

§ 371 Date: Aug. 10, 1995

§ 102(e) Date: Aug. 10, 1995

[87] PCT Pub. No.: WO94/19562

PCT Pub. Date: Sep. 1, 1994

[30] Foreign Application Priority Data

Feb. 20, 1993 [DE] Germany ..... 43 05 302.5

[51] Int. Cl.[6] ..... E04G 11/48

[52] U.S. Cl. ..... 249/210; 249/18; 249/28; 249/30

[58] Field of Search ..... 249/18, 23, 26, 249/28, 30, 210

[56] References Cited

U.S. PATENT DOCUMENTS 1,888,738 11/1932 Roos .

FOREIGN PATENT DOCUMENTS 0297357 1/1989 European Pat. Off. .
0511921 11/1992 European Pat. Off. .
8102261 8/1981 France .
2745065 4/1978 Germany .
3024580 1/1982 Germany .
3316557 10/1984 Germany .
2927116 1/1991 Germany ..... 249/30
4237516 5/1994 Germany ..... 249/28
2266114 10/1993 United Kingdom ..... 249/28
2265654 10/1993 United Kingdom ..... 249/28

OTHER PUBLICATIONS

"Topec–Deckenschalung", Apr. 1991—Thyssen Hünnebeck GmbH.

*Primary Examiner*—Khanh P. Nguyen
*Attorney, Agent, or Firm*—McCormick, Paulding & Huber

[57] ABSTRACT

For use in a ceiling form system with rectangular forms, a support for the forms is provided by a support head having a horizontal base plate mounted in a support column. A horizontal head plate is spaced above the base plate and serves to supportingly engage a corner portion of one or more forms when the forms are in place. The head and base plates are connected with one another by at least one vertical plate section having a horizontal surface engaging the bottom surface of the head plate, a diagonal surface extending from the horizontal surface radially above the head plate and slanting away from the axis of the column, and a stop surface extending vertically above the diagonal surface and in a direction toward the column axis, so that in disassembling a form from the head, after pivoting out of the form, it can be completely removed from the head by only a small amount of raising movement.

7 Claims, 7 Drawing Sheets

CEILING FORM

BACKGROUND OF THE INVENTION

The invention concerns a system ceiling form with ceiling supports and rectangular form components as well as ceiling carriers, whereby vertically standing sections are provided for on a support head containing a head plate which lie in a perpendicular plane containing the support axis and are arranged at a separation from the perpendicular support axis.

In ceiling supports of this kind known in the art through EP 297 357 B 1, a rectangular head plate exhibits arms which extend radially beyond the edges of this plate at the ends of which perpendicular bolts are attached which can engage into the edge regions of a frame of a form component supported on the plate to secure these form components. The four edges of the form components seated on the head plate meet at the extension of the support axis. Radially running raised rods are provided for on the side surfaces of the head plate which seat on the side surfaces of the mutually adjacent form components. The corner of a form component is secured by means of the bolts and the struts.

In the event that the support is to be lowered, removal of the form components between the retracted head plate and the lower surface of the concrete ceiling is difficult, since the corners of the form components are captured between the bolt and the struts and therefore the form components, due to their thickness, prohibit a pivoting motion about an axis running diagonally between the edges. The form components must therefore be raised by the complete height of the bolt in the upper direction when disassembling. This support head is only suitable for the seating of form components and not for the seating of ceiling carriers.

It is therefore the underlying purpose of the invention to develop ceiling forms which are extremely safe in particular when disassembling the ceiling components and nevertheless are easy to handle and whose support heads, while exhibiting a high degree of safety, allow for a simplification of the ceiling form and are suitable for the seating of various components of a ceiling form.

SUMMARY OF THE INVENTION

This purpose is achieved in accordance with the invention in that that the plate sections, as holding means for the ceiling components supported on the support head, engage into the under side of the ceiling components and an additional abutment is provided for the ceiling components above which the ceiling component must be raised following pivoting when disassembling.

This form has the advantage that the ceiling form components, when pivoting, do not unintentionally travel above the abutment or the upper end of this holding means and do not thereby fall down. Following pivoting, it is necessary for the ceiling components to only be raised by a small degree in order to completely remove them from the support. With the introduction of further components ceiling carriers as well as form components can be securely seated on a support head of this type.

For example, form elements can be seated on the ceiling carrier. This form therefore has a plurality of applications.

In embodiments of the invention the plate sections exhibit a front surface facing the support axis which travels in the upper direction in such a fashion that the plate section tapers upwardly, whereby a perpendicular or undercut front surface section forms an adjacent abutment at the upper end of the front surface.

This form has the advantage that the feet of frames of form components are displaced upwardly onto the diagonal surface formed by the tapering during pivoting. In this fashion the stop prevents the ceiling form components from unintentionally travelling over the upper end of this holding means during pivoting to fall down. Following pivoting, it is only necessary to lift the form elements by the small amount corresponding to the height of the stop in order to completely remove them from the support.

When pivoting out, the form components are pivoted about a pivot axis at their foot at the edge. A further advantage of this embodiment is, during disassembly, the form component is lifted, the pivot axis with the feet moving upwardly and outwardly so that the form component moves in the outward direction. When all four form components seat on the support head the lifted form component gains the separation from, the neighboring form components at its edges which it needs due to its thickness in order to pivot in the event that the edge of the form skin lies in a plane with the outer side surfaces of the frame of the form component.

In an other embodiment of the invention a preferentially slot-shaped opening is provided for on the ends of ceiling components configured as ceiling carriers which can accept a raised plate section and the stop is engaged by the carrier after seating of the carrier on the support head and holds the carrier seated on the support head securely in its longitudinal direction. The end of the carrier is secured between the plate section engaged in the opening and the stop. The carrier can be placed from below onto the support head.

Two plate sections can be arranged on the head plate lying in a perpendicular plane containing the support axis and, in embodiments of the invention, four plate sections of this kind are also provided for on the head plate in two perpendicular planes mutually intersecting at right angles.

The head plate can exhibit an arbitrary shape. In one embodiment of the invention the head plate is, however, rectangular and the plate sections run radially inwardly from the edges. This embodiment of the invention has the advantage that the pivoting of the ceiling components is not prematurely hindered by edges of the head plate.

In an embodiment of the invention the perpendicular plate sections extend beyond the edge of the head plate which, for its part, contributes to the fact that the ceiling form parts supported on the ceiling head can be pivoted away from parts of the supporting heads in as free a manner as possible.

The stop can be provided for at an arbitary location on the support head. In an embodiment of the invention this stop is provided for on a part connected to the head plate as an extension of the plate section at a separation from the plate edge. This stop can, in embodiments of the invention, be positioned below the plane of the head plate.

Further features of the invention can be derived from the following description of embodiments of the invention in connection with the claims and the drawing. Separate features can be utilized individually or collectively in embodiments of the invention.

DESCRIPTION OF THE PREFERRED EMBODIMENT

Figure 1:
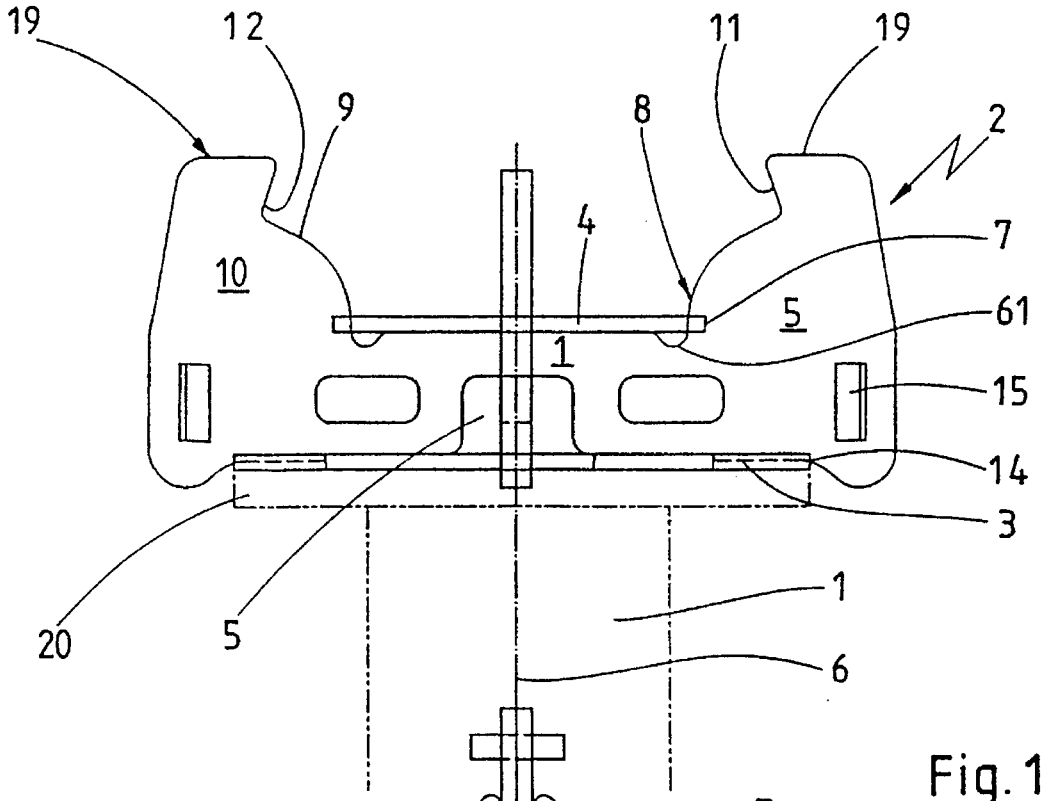
FIG. 1 shows a view of an embodiment of a supporting head in an embodiment of the ceiling form in accordance to the invention.
Figure 2:
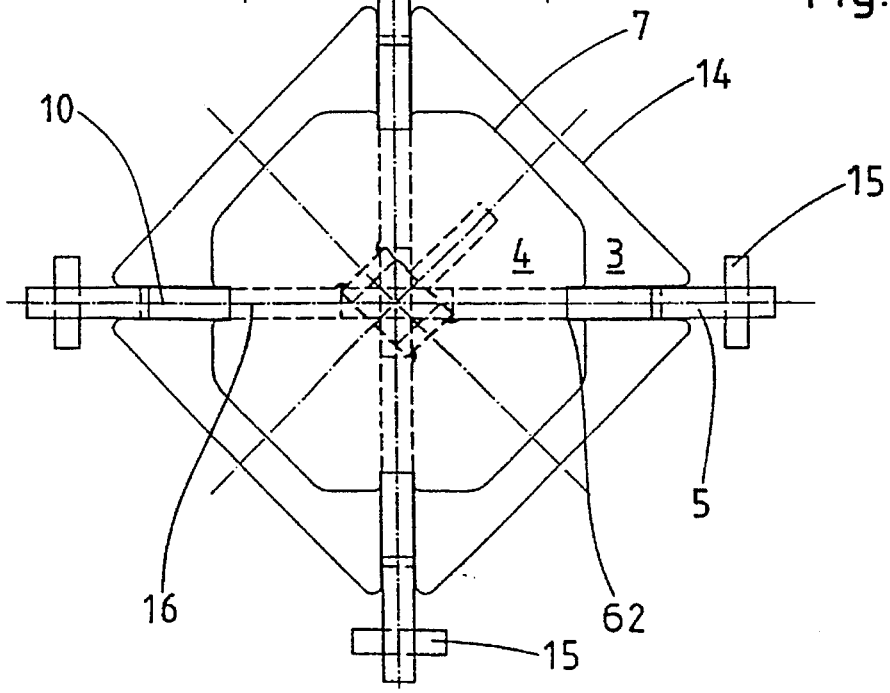
FIG. 2 shows a plan view of this supporting head according to FIG. 1.

In the embodiment of the invention represented in FIG. 1, a supporting head, designated in its entirety with 2, is attached to the upper end of a support 1. This supporting head exhibits a base plate 3 as well as a head plate 4 at a separation of for example 50 mm above the base plate 3 which is somewhat smaller than the base plate 3. The head plate 4 is connected to the base plate 3 by means of perpendicularly arranged struts 16 which are cross-wise arranged and which intersect at the longitudinal support axis 6. Perpendicularly arranged plate sections 5 and 10 are adjacent to the ends of the struts 16, serve as supports for ceiling components and penetrate through the head plate 4 by means of a slot 62 at a relative small separation from its edge 7 so that a relatively large intermediate space obtains between its front surface 8 extending upwardly beyond the head plate 4 which faces the support axis 6 and the front surface 9 of the oppositely lying perpendicular plate section 10. The front surfaces 8 and 9 run in a curved fashion upwardly so that the plate sections 5 and 10 taper in the upward direction. Approximately perpendicular or undercut surface sections 11 and 12 are adjacent at the upper end of the front surfaces 8 and 9 which form a stop for a part of a form component sliding on the surfaces 8 and 9.

The base plate 3 is square, and the perpendicular plate sections 5 and 10 run radially inwardly from the corners of this square. The head plate 4 has eight sides in the embodiment shown but can equally have, for example a square shape.

The perpendicular plate sections 5 and 10 extend beyond the edge 7 of the head plate 4 and the edge 14 of the base plate 3 radially in the outer direction. The plate sections 5 and 10 exhibit a stop 15 penetrating through the plate section at approximately its outer end.

Figure 3:
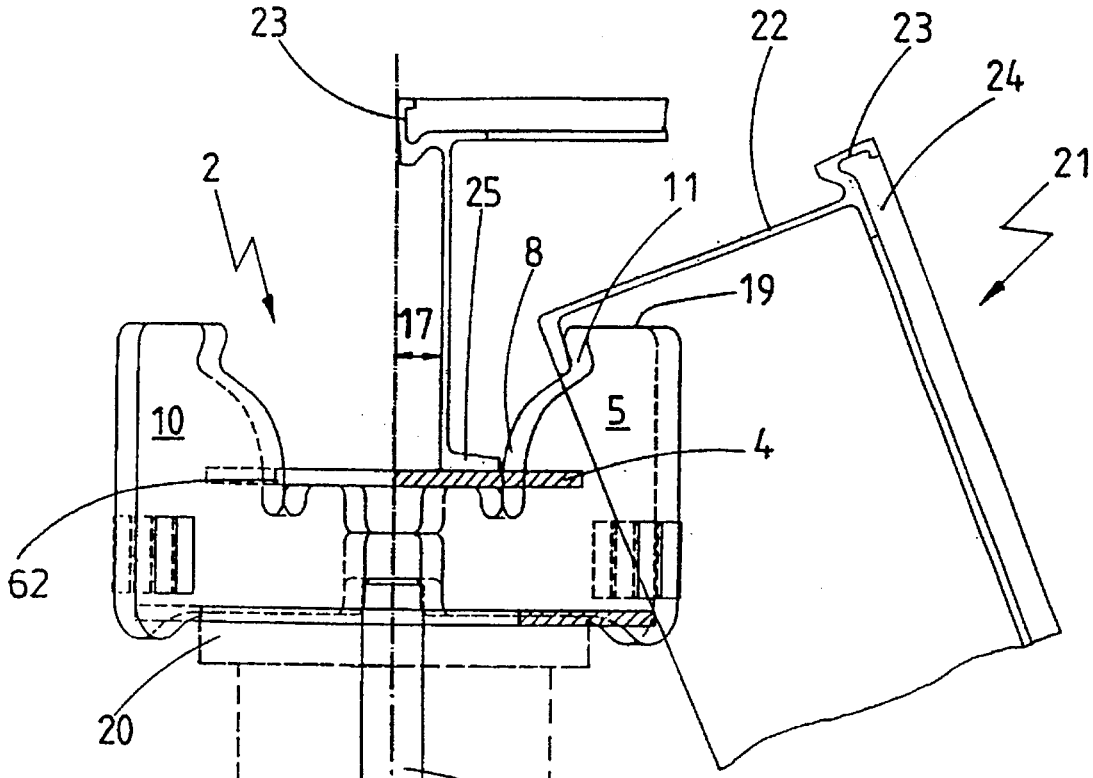
FIG. 3 shows a view corresponding to that of FIG. 1 of an embodiment of a ceiling form with which the form components directly seat on the supporting head.
Figure 4:
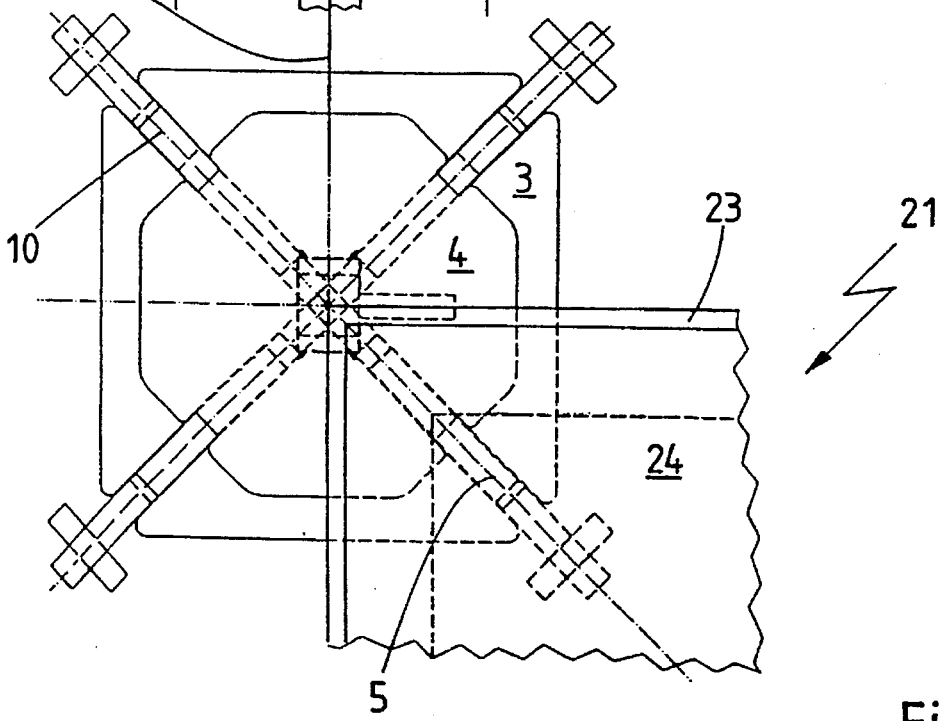
FIG. 4 shows a plan view of a configuration according to FIG. 3.

The embodiment of the invention represented in FIGS. 3 and 4 describes the seating of form components 21 on the supporting head 2. The support head represented in FIG. 3 exhibits a central rod 18 at its lower side which is sunken into the upper end of a support 1 and attached thereto. The support 1 additionally exhibits an attachment plate 20 upon which the support head 2 with its base plate 3 is placed and to which it can likewise be attached.

A form component 21 is supported on the head plate 4 of the supporting head 2 which exhibits a surrounding frame 22 which bears a collar-like flange 23 at its upper end in which a form skin 24 made from laminated wood is attached. The metal frame 22 exhibits an inwardly directed foot 25 at its lower end with which it seats on the head plate 4. The flange 23 is configured as a drip edge. The outer edge of the flange 23 runs, when the form component is seated on the head plate 4, in a longitudinal middle plane from which the foot 25 exhibits a certain separation 17. As shown in FIG. 4 four form components 21 can be placed on the head plate 4 so that the edges of the flanges 23 seat in close proximity to another. The edges of the four rectangular form components 21 lie in the vicinity of the support axis 6. The plate sections 5 and 10 thereby run at an angle of 45° with respect to the walls of the frame 22. The front surfaces 8 facing the support axis 6 thereby engage from below and from the inside into the edges of the form component. The inner edge of the foot 25 of the frame 22 thereby closely seats or seats with play at the lower end of the front surface 8 so that four form components 21 placed on the head plate 4 are held in a non-displaceable fashion.

In the embodiment shown the front surfaces 8 are curved. They could, however, also extend in an even fashion or the plate section 5 can exhibit a differing shape. Important is that the lower frame edge of the form component which is seated is held with a small degree of play and the cross-section of the plate section 5 tapers in the upward direction so that the side walls of the frame initially pivot about the inner edge of the foot 25 when pivoting out the form component during disassembly of the ceiling form. Beyond a certain tilt angle, the foot 25 or the lower end of the frame 25 glides, either initially without seating of the frame 22 on the upper edge 19 or with seating on the upper edge 19, on the surface 8 in the upward direction until it comes to rest at stop 11. In an embodiment not shown whose dimensioning is chosen to be somewhat different than the embodiment represented in the drawing, for example when the stop 11 and thereby the plate section 5 are provided in a more outward direction, in this position the inner surface of the frame 22 seats on the upper horizontal front surface 19 of the plate section 5 or 10 and the form component 21 hangs approximately perpendicular in a downward direction. In the event that the form component is then further pivoted inwardly from this position the pivot motion takes place about a pivot axis extending along the front surface 19. This pivot motion is limited in that the frame of the form component seats on the edge of the base plate 3 or on the support 1. During this continued pivoting the foot 25 is somewhat lifted and is displaced upwardly to the stop 11. The dimensions can be choosen in such a fashion that the foot 25 distinctly engages the stop 11 at the end of the pivoting motion so that the form component 21 must be somewhat raised to free the foot from the stop 11. Embodiments are however conceivable with which the stop 11 is so small that it, during a continued pivoting of the form component 21, is completely freed out of its perpendicular position from the stop 11. It is clearly also possible, without continued pivoting of the form component 21 out of its perpendicular position, to sufficiently lift the form component such that the foot 25 is freed from the stop 11 and the form component can be lifted. The stop 15 serves no function with this particular embodiment of the ceiling form in accordance with the invention.

Figure 7:
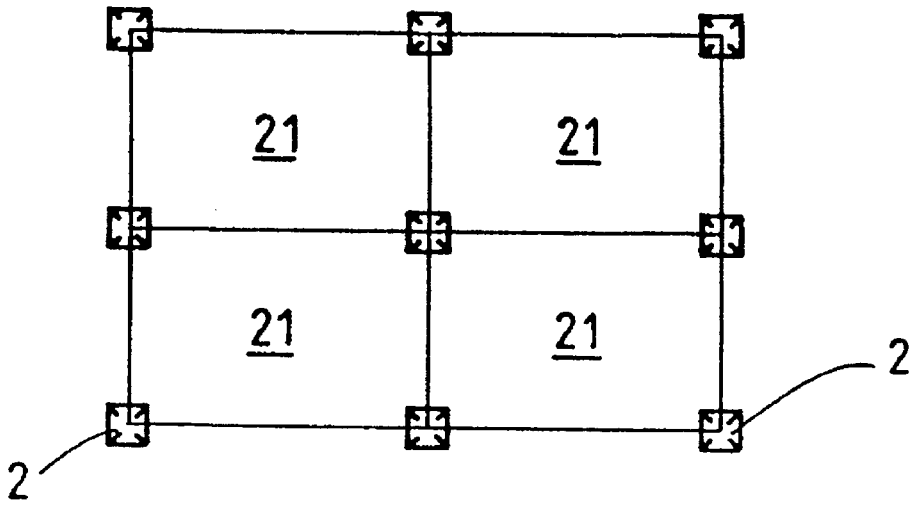
FIG. 7 shows a schematic system diagram in plan view of the embodiment according to FIG. 3.

FIG. 7 schematically shows a system diagram of an embodiment of the form represented in FIG. 3. The four corners of a form component 21 are seated on four supporting heads 2 and are held thereon by means of the corresponding plate sections 5 or 10. The other form components 21 are stacked adjacently in close proximity.

In the embodiments of the invention represented in FIGS. 5 and 6 longitudinal ceiling carriers 26 are placed on the base plate 4 which display diagonal upwardly directed tabs 28 at their upward surface 27 which engage from below behind the lower edge and foot 25 of the frame 22 of the form components 21 placed on the surface 27 and thereby hold the form component 21 on the carrier 26 in non-displaceable fashion.

The end of the carrier 26 exhibits a perpendicular front surface 29. A foot 30, running transverse to the longitudinal axis of the support, seats on the plate 4 to increase its seating surface and thereby its resistance to tilting about the longitudinal axis of the carrier. The end of the ceiling support 26 exhibits a slot which is open in the downward direction, which extends over approximately two thirds of the carrier height, and which either likewise penetrates the front surface 29 or the slot 31 in the vicinity of the front surface 29 is sealed by a perpendicular plate 32.

The lower edge 33 of the carrier 26 initially runs over a short distance parallel to the longitudinal axis of the carrier in order to guarantee a good seating on the plate 4 of the support head. The edge 33 then runs diagonally in an upward direction and then continues via a bend 34, which can extend through 90°, into a section 35 which runs diagonally in a downward direction and which defines a downwardly extending protrusion 36. The edge section 35 runs at a small separation from the edge of the head plate 4 in a downward direction. The protrusion 36, when the carrier 26 is in place, engages behind the stop 15 arranged below the plane of the head plate 4. The slot 31 also runs in the longitudinal midplane of the protrusion 36. When placing the carrier 26 onto the supporting head 2, the plate section 5 enters into the slot 31 so that the support 26 is held by the plate section 5 engaging the slot 31 and by the protrusion 36 engaging the stop 15.

In the embodiment of the invention represented the front surface 29 exhibits a small separation 37 from the support axis 6, the edge section 35 an approximately equally large separation 38, and the edge of the protrusion 36 facing the stop 15 a smaller separation 39 from the stop 15. The carrier 26 is thereby seated on the head 2 in a manner allowing small longitudinal displacement so that tolerances in the dimensioning of the form components 21 can be compensated for when the position of the front surface 40 on the flange 23 is determined by the seating on the neighboring form component.

The carrier 26 load is directly carried at the center of the support head by the short horizontal section of the edge 33.

The edge of the protrusion 36 facing the stop 15 initially runs in an upward direction in a section 41 approximately at right angles to the longitudinal carrier axis followed by an approximately semi-circular-shaped indentation 42 directed towards the end of the carrier. Adjacent thereto is an edge section 43 which is parallel to the longitudinal axis of the carrier and which ends in the edge 44 and runs to the lower border 45 of the carrier.

The pivoting-out motion of the carrier 26 when disassembling the form can, depending on the chosen dimensional relationships, have different detailed dependences. In the embodiment of the invention shown, the bend 34 initially seats on the edge of the head plate 4 when pivoting out the carrier 26 so that the protrusion 36 sinks somewhat deeper into the support head 2. When pivoting further the round indentation 42 seats on the upper surface of the stop 15 so that a further pivoting about this seating of the rounded portion of the indentation 42 on the upper surface of the stop 15 occurs until a corner 46 at the support-sided end of the edge section 45 seats on the periphery 47 of the support 1. Depending on the dimensional relationships, the front plate 32 can thereby also come to rest on the upper edge of the plate section 5.

In the embodiment shown, in this pivoting position, one flank 48 of the indentation 42 engages the stop 15 so that the carrier 26, in this position, must be slightly lifted in order that the flank 48 is freed from the stop 15 so that the carrier can be displaced at right angles with respect to the support axis and removed from the support.

In this embodiment of the invention the plate sections 5 and 10 serve the purpose of giving the carrier 26 adequate support perpendicular to its longitudinal axis since these plate sections enter into the slot 31. The front surfaces 8 of the plate sections 5 and 10 have, in this embodiment of the ceiling form, no particular function or at most that of guiding the front plate 32 along the surface 8 in a downward direction when seating the carrier from above in the event that it is placed at a correspondingly large separation from the support axis 6 and first then displaced in a direction towards the support axis so that the protrusion 36, in the intermediate space between the stop 15 and the edge of the head plate 4, can move downward.

Figure 5:
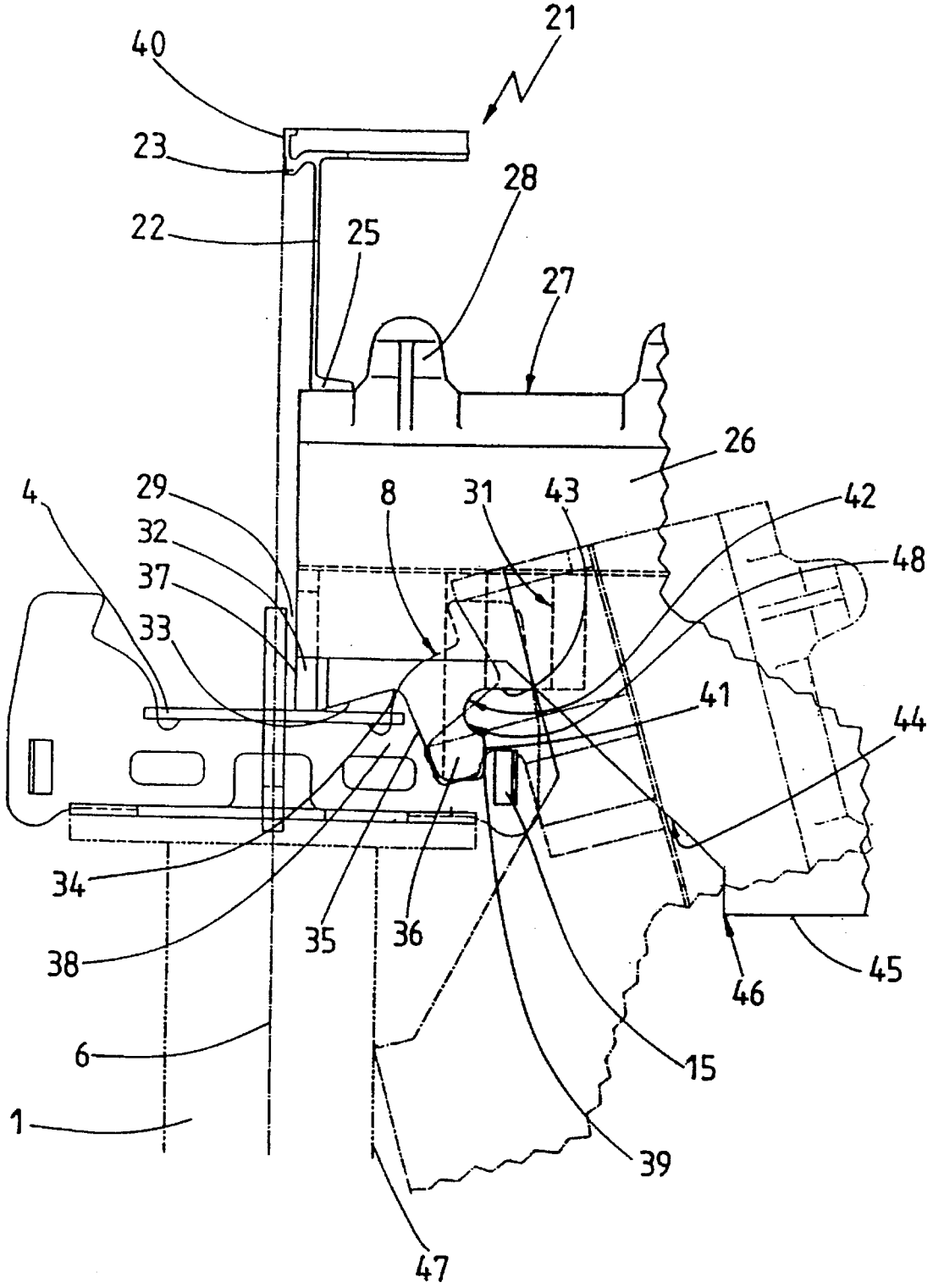
FIG. 5 shows a view of an additional embodiment of the ceiling form with carriers seated on the supporting head and form components 21 placed thereupon.
Figure 6:
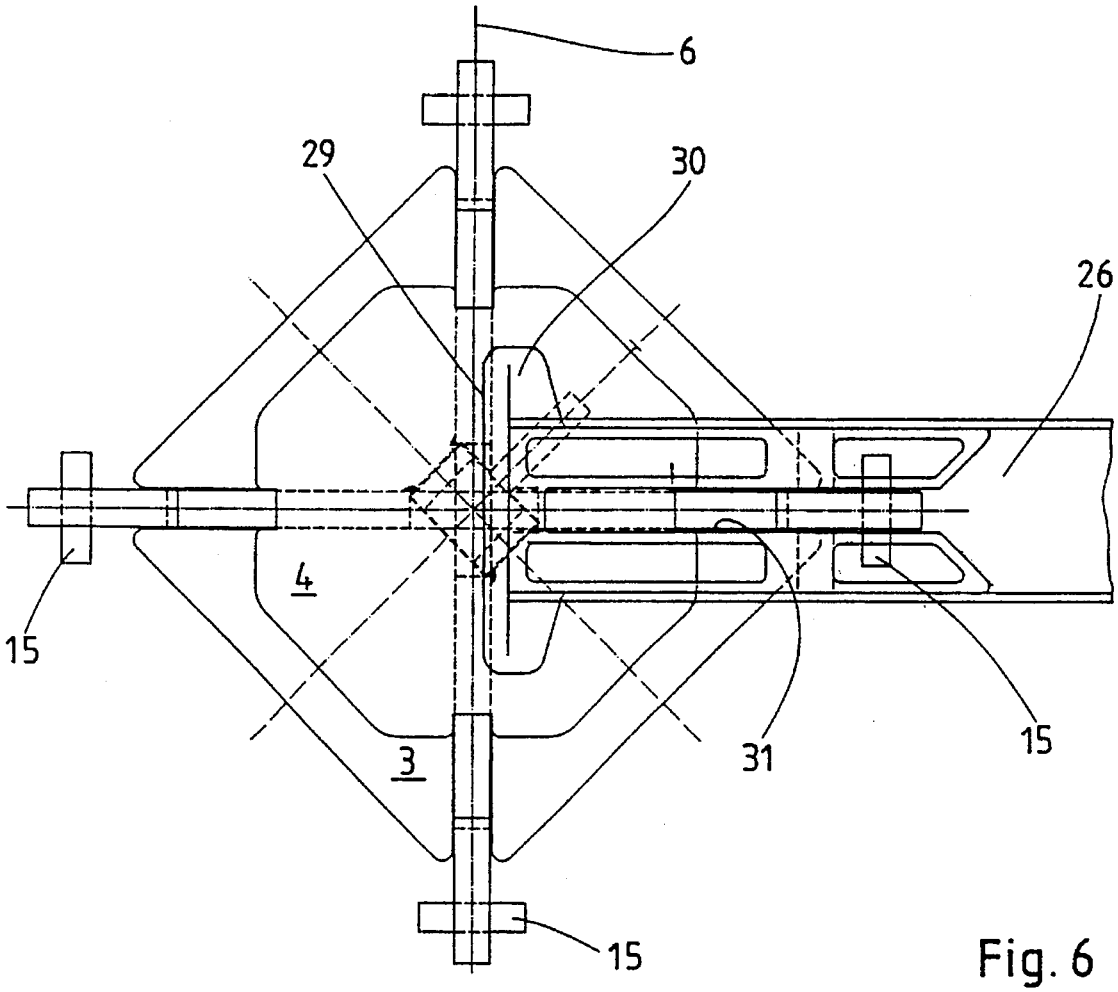
FIG. 6 shows a plan view of the embodiment according to FIG. 5.
Figure 8:
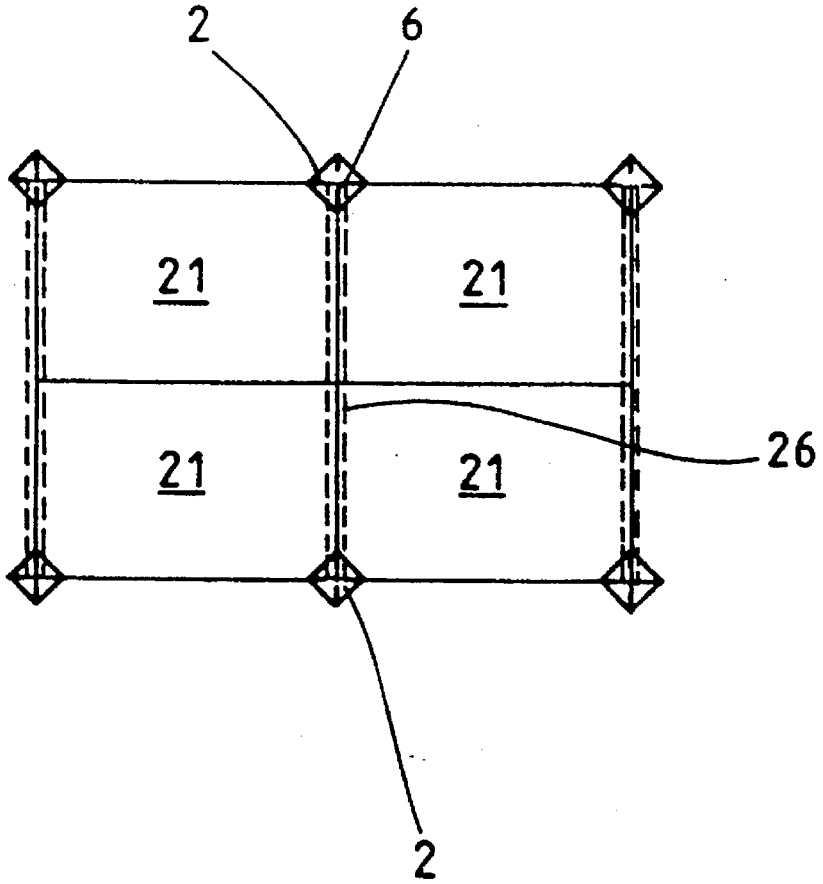
FIG. 8 shows a representation corresponding to that of FIG. 7 of the embodiment according to FIG. 5.
Figure 9:
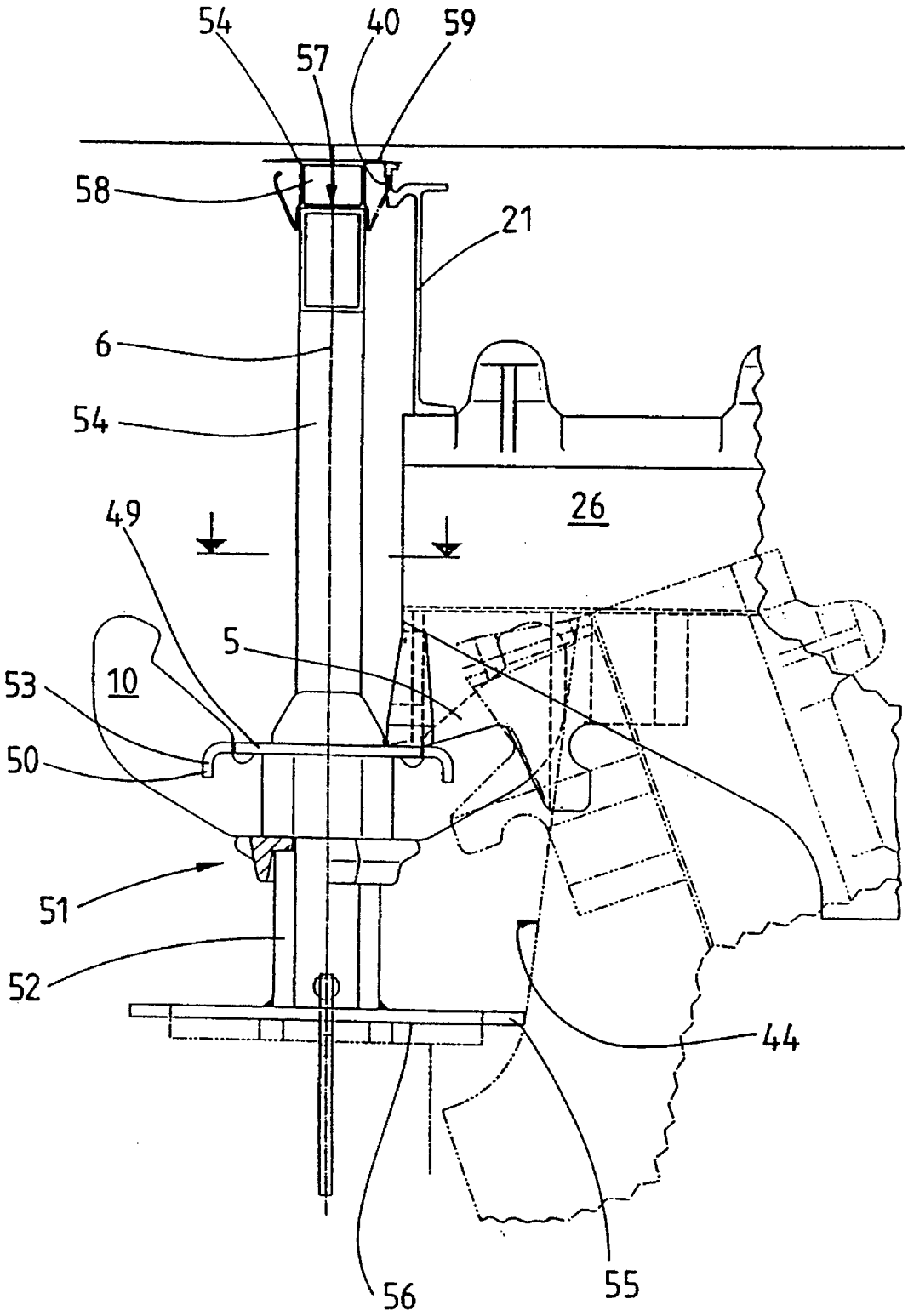
FIG. 9 shows an embodiment of the ceiling form in accordance with the invention with utilization of a fall bushing and FIG. 10 shows a corresponding representation of an additional embodiment of the form at the beginning of the wall.

FIG. 8 shows a system diagram of the embodiment shown in FIGS. 5 and 6. The carrier 26 runs over two opposite corners of the base plate 3 of the support head 2. In this embodiment of the invention two, for example, form components 21 are each placed on both upper longitudinal side edges of the carrier 26, that is to say at both sides of the carrier 26, the edges of which are closely adjacent to each other and also above the support head 2. The edges of four form components 21 lie, in extension of the support axis 6, in mutual adjacency.

In embodiments of the ceiling form in accordance with the invention with which the support head 51 is arranged on a fall bushing 52, the ends of a ceiling carrier cannot be adequately placed up to the support axis 6 on the support head since an upwardly protecting support section 54 extends between the front surface of the one carrier and the front surface of the adjacent carrier on which the fall bushing can be lowered. In this case the carrier 26 is placed somewhat outwardly on the head plate of the support head. The head plate 49 is then reenforced by means of a bevel 50 so that the load which is located somewhat further from the support axis 6 due to the carrier 26 can be easily taken up by the support head 51. In this embodiment of the ceiling form a stop 15 is not necessary on the support head 51 provided on a fall bushing 52. The carrier 26 is pivoted over the edge 53 of the head plate 49. A protrusion on the lower side of the carrier 26 corresponding to the protrusion 36 in FIG. 5 serves no function in this embodiment of the ceiling form. The pivoting motion of the carrier 26 is, in this embodiment, limited in that the edge section 44 on the lower side of the carrier 26 is adjacent to an edge 55 of a base plate 56 of the support head or the fall bushing 52.

The support section 54 guiding the fall bushing 52 runs between the front surfaces of both ends of the carrier 26 seated on the support head and thereby between the front surfaces 40 of the form component 21 placed on the carrier 26. The upper front surface 57 of the support section 54 is, in this embodiment of the ceiling form, covered with a strip 58 preferentially made from plastic whose flanges 59 close the joint between the front surface 40 and the support section 54. The plate sections 5 and 10 also engage into the slot 31 of the carrier 26 in this embodiment and hold same transverse to the longitudinal direction of the carrier.

Figure 10:
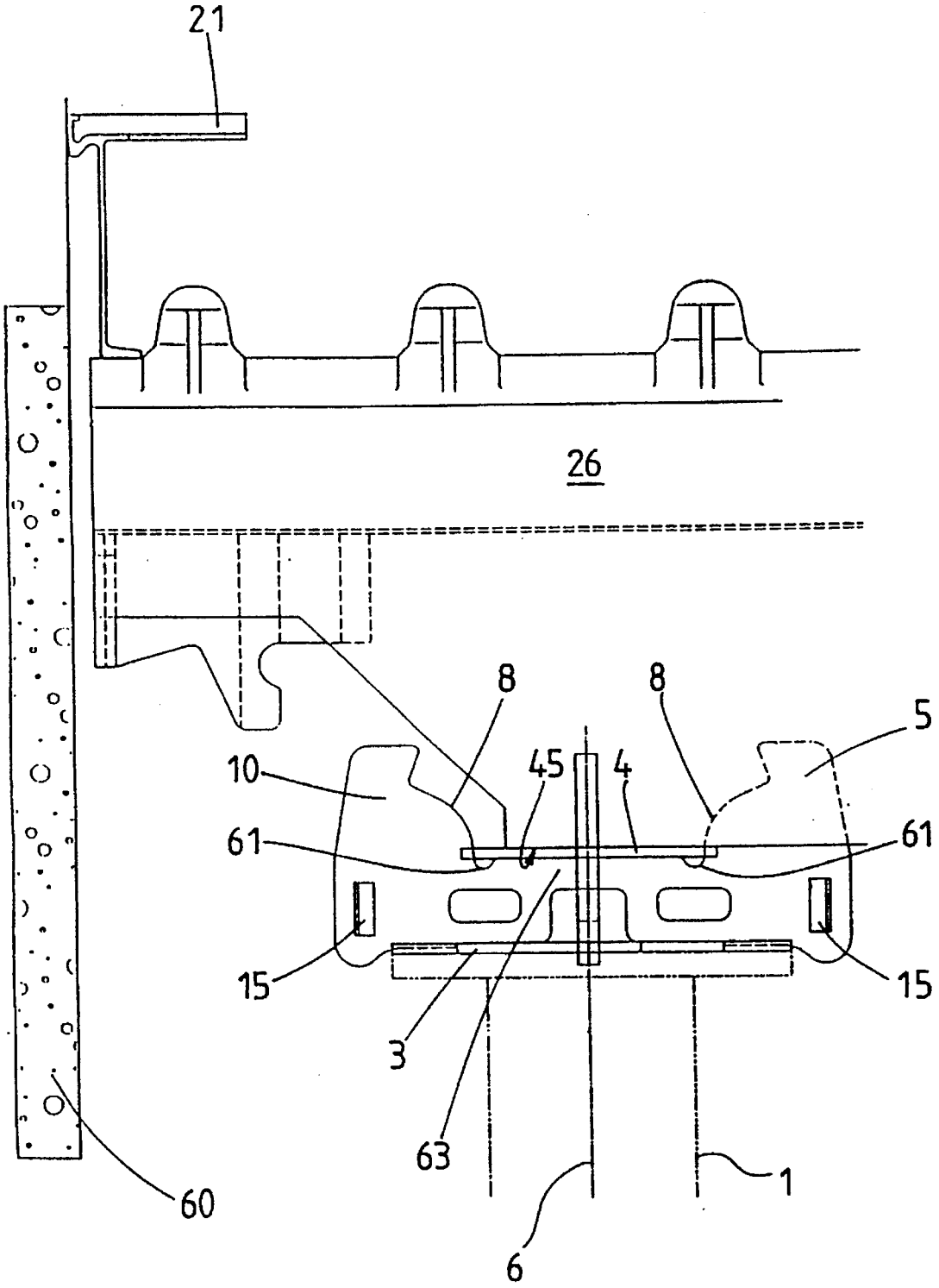

FIG. 10 shows an embodiment of the ceiling form on the edge of the form surface, preferentially at the beginning of a wall. The ceiling carrier 26 can be placed onto the support head 2 in such a fashion that its lower edge 45 is seated on the head plate 4. In this fashion the plate sections 5 and 10, for their part, engage into a slot in a lower part of the carrier 26 and secure the carrier 26 transverse to its longitudinal direction. The carrier 26 can be arbitrarily displaced in the direction towards a wall 60 within certain limits. The form components 21, for their part, are placed on the upper surface of the carrier 26. The support 1 has an appropriate spindle.

In all embodiments of the support head utilized, the edge of the plate sections 5 and 10 facing away from the support axis 6 runs outside of the head plate 4 and also outside of the base plate 3. The edge of the head plate 4 is slotted at those locations at which the plate sections 5 and 10 penetrate through the head plate 4. In embodiments of the invention, a small rounded portion 61 can be adjacent to the front surface 8 below the head plate 4.

When pivoting up the ceiling carrier to erect a ceiling form, the carrier is secured in such a fashion that it does not fall down. This is done by seating the head plate 32 on the upper surface of the plate section 5, 10 and the rounded portion of the indentation 42 is also seated on the upper surface of the stop 15.

We claim:

1. A support head for supporting ceiling form components, said support head being mounted upon a support defining a vertical support axis and said support head comprising:

a generally horizontal base plate mounted on the support and having an upwardly facing top surface;

a generally horizontal head plate located at a separation above said base plate and having a downwardly facing bottom surface; and a first plate section defining a first vertical plane containing the support axis, said first plate section having an upper horizontal surface extending radially from the support axis and adjacent to said bottom surface of said head plate, a diagonal surface extending from said horizontal surface radially above said head plate and slanting away from the support axis, and a stop surface extending vertically above said diagonal surface in a direction towards the support axis, said first plate section having a bottom surface adjacent to said top surface of said base plate to connect said base plate to said head plate.

2. A support head for supporting ceiling form components, said support head being mounted upon a support defining a vertical support axis and said support head comprising:

a generally horizontal base plate mounted on the support and centered at the support axis and having an upwardly facing top surface;

a generally horizontal head plate located at a separation above said base plate and centered about the support axis and having a downwardly facing bottom surface of smaller size than said top surface of said base plate; and a first plate section defining a first vertical plane containing the support axis, said first plate section having a radially outer surface, an upper horizontal surface extending radially from the support axis adjacent to said bottom surface of said head plate, a diagonal surface expending from said horizontal surface radially above and radially beyond said head plate and slanting away from the support axis, and a stop surface extending vertically above said diagonal surface and slanting towards the support axis, said first plate section having a bottom surface adjacent to said top surface of said base plate to connect said base plate to said head plate, said first plate section also having a second stop arranged below a plane of said head plate and above a plane of said base plate and radially beyond said base plate near said radially outer surface of said first plate section.

3. A support head for supporting ceiling form components, said support head being mounted upon a support defining a vertical support axis and said support head comprising:

a generally horizontal base plate mounted on the support and centered at the support axis and having an upwardly facing top surface;

a generally horizontal head plate located at a separation above said base plate and centered about the support axis and having a downwardly facing bottom surface of smaller size than said top surface of said base plate;

a first plate section defining a first vertical plane containing the support axis, said first plate section having a radially outer surface, an upper horizontal surface extending radially from the support axis adjacent to said bottom surface of said head plate, a diagonal surface extending from said horizontal surface radially above and radially beyond said head plate and slanting away from the support axis, and a stop surface extending vertically above said diagonal surface and slanting towards the support axis, said first plate section having a bottom surface adjacent to said top surface of said base plate to connect said base plate to said head plate, said first plate section also having a second stop arranged below a plane of said head plate and above a plane of said base plate and radially beyond said base plate near said radially outer surface of said first plate section, said first plate section further having a shape which is mirror symmetric with respect to a second vertical plane containing the support axis and perpendicular to said first vertical plane; and a second plate section having a shape identical to said first plate section shape, said second plate section lying in said second vertical plane, said support head, in plan view, having a rectangular shape with four corners, and said first plate section extending radially inwardly from one of said corners of said rectangular shape.

4. The support head of claim 1, further comprising a second plate section, defining a second vertical plane containing the support axis and perpendicular to said first vertical plane, and wherein said head plate is attached to said first and second plate sections.

5. The support head of claim 1, wherein said first plate section has a radially outer surface, said first plate section further comprises a second stop arranged below a plane of said head plate and above a plane of said base plate near said radially outer surface of said first plate section.

6. The support head of claim 1, wherein said signal surface curves in a concave downward manner.

7. The support head of claim 1, wherein the support head, in plan view, has a rectangular shape with four corners, said first plate section extending radially inwardly from one of said corners of the rectangular shape.

* * * * *